US008490447B2

(12) United States Patent
Kurz et al.

(10) Patent No.: US 8,490,447 B2
(45) Date of Patent: Jul. 23, 2013

(54) METHOD FOR ADJUSTING A STATE OF A ROLLING STOCK, PARTICULARLY A NEAR-NET STRIP

(75) Inventors: Matthias Kurz, Erlangen (DE); Birger Schmidt, Brand-Erbisdorf (DE); Klaus Weinzierl, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 602 days.

(21) Appl. No.: 12/670,897

(22) PCT Filed: Jul. 24, 2008

(86) PCT No.: PCT/EP2008/059694

§ 371 (c)(1),
(2), (4) Date: Jan. 27, 2010

(87) PCT Pub. No.: WO2009/016086

PCT Pub. Date: Feb. 5, 2009

(65) Prior Publication Data

US 2010/0192660 A1 Aug. 5, 2010

(30) Foreign Application Priority Data

Jul. 27, 2007 (DE) ..... 10 2007 035 283

(51) Int. Cl.
*B21B 13/04* (2006.01)
*B21B 31/32* (2006.01)

(52) U.S. Cl.
USPC ..... 72/8.1; 72/8.3; 72/8.9; 72/9.2; 72/9.3; 72/11.6; 72/11.8; 72/11.9; 72/16.2; 72/20.1; 72/232

(58) Field of Classification Search
USPC ..... 72/8.1, 8.3, 8.9, 9.2, 9.3, 11.6, 11.8, 72/11.9, 16.2, 20.1, 21.1, 232, 235, 241, 72/243, 245, 247, 243.2
See application file for complete search history.

(56) References Cited

U.S. PATENT DOCUMENTS 4,570,472 A * 2/1986 Kuwano ..... 72/8.4
4,683,744 A * 8/1987 Ginzburg et al. ..... 72/241.4

(Continued)

FOREIGN PATENT DOCUMENTS

DE 3116278 11/1982
DE 102005021769 11/2006

(Continued)

OTHER PUBLICATIONS

International Search Report for Application No. PCT/EP2008/059694 (13 pages), Oct. 14, 2008.

(Continued)

*Primary Examiner* — David B Jones
(74) *Attorney, Agent, or Firm* — King & Spalding, L.L.P.

(57) ABSTRACT

In a method and a control device for adjusting a state of a rolling stock, particularly a near-net strip, defined at least by an out-of-parallel condition and/or a curvature of the rolling stock, the rolling stock is transitioned from an initial into an intermediate state by a roll stand and by impressing a stress onto the rolling stock by an additional processing device, and the rolling stock is transitioned from the intermediate into a final state by at least one processing aggregate. By determining whether rolling stock should be fed into the at least one processing aggregate, the intermediate state requiring a non-zero out-of-parallel condition and/or curvature in order to achieve a predetermined final state, and the roll stand and/or the processing device are controlled and/or regulated as a function thereof to adjust the required intermediate state, the shape reliability of an ultimately parallel, non-curved rolling stock can be increased.

13 Claims, 2 Drawing Sheets

U.S. PATENT DOCUMENTS

| | | | | |
|---|---|---|---|---|
| 4,759,205 | A * | 7/1988 | Kuwano et al. | 72/9.3 |
| 6,571,134 | B1 | 5/2003 | Gramckow et al. | 700/29 |
| 6,983,631 | B2 | 1/2006 | Seidel | 72/7.6 |
| 8,256,494 | B2 * | 9/2012 | Reifferscheid et al. | 164/442 |
| 2009/0044587 | A1 | 2/2009 | Jepsen et al. | 72/234 |

FOREIGN PATENT DOCUMENTS

| | | | |
|---|---|---|---|
| DE | 19980248 | | 2/2008 |
| JP | 59110408 | | 6/1984 |
| JP | 59158749 | | 9/1984 |
| JP | 4111911 | | 4/1992 |
| JP | 11010215 | | 1/1999 |
| JP | 2002126813 | | 5/2002 |
| JP | 2002210513 | | 7/2002 |
| RU | 2003131972 | A | 2/2005 |
| SU | 440174 | A1 | 8/1974 |
| SU | 787124 | A1 | 12/1980 |
| SU | 1242267 | A1 | 7/1986 |
| WO | 2006119984 | | 11/2006 |

OTHER PUBLICATIONS

Office Action for German Application No. 10 2007 035 283.4 (6 pages), Apr. 28, 2008.

* cited by examiner

METHOD FOR ADJUSTING A STATE OF A ROLLING STOCK, PARTICULARLY A NEAR-NET STRIP

CROSS-REFERENCE TO RELATED APPLICATIONS

This application is a U.S. National Stage Application of International Application No. PCT/EP2008/059694 filed Jul. 24, 2008, which designates the United States of America, and claims priority to German Application No. 10 2007 035 283.4 filed Jul. 27, 2007, the contents of which are hereby incorporated by reference in their entirety.

TECHNICAL FIELD

The invention relates to a method for setting a state of a rolling stock, particularly a near-net strip, which is defined at least by a thickness taper and/or a camber of the rolling stock, the rolling stock being transformed from an initial state into an intermediate state by rolling by means of a roll stand, in particular a roughing stand, and by impressing a stress onto the rolling stock by means of additional processing means, and the rolling stock being transformed from its initial state into a final state by means of at least one processing unit.

BACKGROUND

All the installations that are required for producing rolled products may be combined in a rolling mill. Depending on the type of forming, a distinction is drawn between hot and cold rolling mills. In the hot rolling mills or wide hot strip rolling mills, roughed slabs or ingots, usually called slabs for short, are processed into hot strip. This hot forming is one of the processes that follow the primary forming (ingot casting, continuous casting). In this process, the rolling stock is heated to temperatures of up to 1350° C. and, preferably while above its recrystallization temperature, is reduced to a predetermined thickness by pressure in a roll nip of the rolling mill. The overall complex of a hot rolling mill may include: raw material stores; heating furnaces, descaling installations; roughing and finishing trains with different numbers of stands, groups of stands and types of stands; coilboxes; cooling devices; adjusting devices; coiler(s) and finished material stores. Furthermore, a rolling mill may include stores; transporting and guiding devices and extensive regulating, controlling and measuring systems.

Since the finished product (usually steel or aluminum strip) can only rarely be rolled out in a single pass, a number of roll stands are combined to form a rolling train, in which a number of rolling passes are performed in accordance with the number of passes through the stands. In hot rolling mills, a distinction is drawn between the roughing train and the finishing train, the slab being preprocessed in the roughing train in order subsequently to be rolled out to its final dimensions in the finishing train, usually comprising five, six or seven stands.

In the rolling mill, the roll stands represent the central installation parts. The roll housings of the roll stands must absorb the high rolling forces that occur and thereby expand as little as possible. The roll bearings of the roll housings provide correct guidance of the rolls and transfer the rolling forces to the roll housings via the adjusting system, the adjusting devices of the adjusting system serving for horizontal and vertical positioning of the rolls. The adjusting devices may be actuated mechanically, electromechanically or hydraulically. Generally, during the rolling of wide hot strip, four-roll stands, known as four-high stands, are used, comprising two working rolls and two backing rolls, the backing rolls usually having a greater diameter than the working rolls.

One of the problems when rolling slabs or the strips produced from them is that the rolling stock to be rolled in a roughing train has a variation in thickness over its width. The aim is generally to use rolling as a means of producing strips which on the one hand have a thickness over the width that is substantially symmetrical in relation to the middle of the strip, i.e. have no taper, and on the other hand have as little curvature as possible over the length of the rolling stock, i.e. have no camber.

However, this is difficult to achieve whenever a rolling stock that is already formed with thickness taper during the first rolling within the hot rolling train has to be rolled. The thickness taper of the rolling stock is generally a result of the casting process and the subsequent cooling and further processing, in particular halving, of the cast slabs.

If rolling stock with a thickness taper is to be rolled out into a slab with a substantially rectangular cross section, then there is generally a stronger material flow, particularly longitudinal flow, on the "thick" side of the slab than on the "thin" side of the slab on account of the volume being maintained. A result of this differing material flow in the longitudinal direction of the rolling stock is the formation of a camber. A cambered rolling stock may, depending on the degree of camber, lead to difficulties in the subsequent processing of the rolling stock. The formation of the camber may be so pronounced that further processing of the rolling stock is impossible.

Laid-out patent application WO 2006/119984 A1 discloses a method and a device for specifically influencing the geometry of a near-net strip in a roughing stand, with slabs being rolled out into near-net strips in one or more roughing stands. A method which makes it possible to produce straight near-net strips without thickness taper and without lateral curvature can be provided by achieving specific influencing of the roughing strip geometry on at least one roughing stand by corresponding regulating means of a dynamic adjustment in the roughing stand being interconnected with fast and powerful lateral guides upstream and downstream of the roughing stand in such a way that a slab with camber and thickness taper is transformed specifically into a straight near-net strip with no taper in one or more passes in a reversing or continuous operating mode.

A disadvantage of the teaching specified in the above laid-open application is that only straight near-net strips without thickness taper and without lateral curvature are produced there. This form of the rolling stock with no camber and with no taper may, however, be lost again by subsequent processing of the rolling stock. Furthermore, use of the fast and powerful lateral guide may entail the occurrence of high forces, which may lead to defective lateral guidance and great, and therefore disadvantageous, loading of the edge of the near-net strip.

SUMMARY

According to various embodiments, a method of the generic type specified at the beginning can be provided which increases the reliability of the form of a rolling stock that ultimately has no thickness taper or camber.

Furthermore, according to further embodiments a control device for performing such a method can be provided.

According to an embodiment, a method for setting a state of a rolling stock, particularly a near-net strip, which is defined at least by a thickness taper and/or a camber of the rolling stock, may comprise the steps of transforming the rolling stock from an initial state into an intermediate state by rolling by means of a roll stand, in particular a roughing stand, and by impressing a stress onto the rolling stock by means of additional processing means, and transforming the rolling stock from its initial state into a final state by means of at least one processing unit, wherein it is determined whether the at least one processing unit should be fed a rolling stock of an intermediate state that requires a thickness taper and/or camber other than zero in order to achieve a predetermined final state and, dependent thereon, the roll stand and/or the processing means are controlled and/or regulated to set the respectively required intermediate state.

According to a further embodiment, allowance can be made in the determination for an internal material stressing with an effect at least on the thickness taper and/or camber of the rolling stock during the further processing of the rolling stock. According to a further embodiment, the stress impressed onto the rolling stock can be regulated and/or controlled.

According to a further embodiment, a force exerted on the rolling stock can be used for impressing the stress onto the rolling stock. According to a further embodiment, the force exerted for impressing the stress onto the rolling stock can be controlled and/or regulated. According to a further embodiment, the rolling stock may have a front side that is generally aligned transversely in relation to an intended transporting direction and is known as the head of the rolling stock, a position of the head of the rolling stock being recorded and the force exerted on the rolling stock being regulated and/or controlled on the basis of the recorded position of the head of the rolling stock. According to a further embodiment, a lateral guide can be used as the processing means. According to a further embodiment, an edger can be used as the processing means. According to a further embodiment, working rolls comprised by the edger are not arranged axially symmetrically in relation to a center longitudinal axis of the rolling stock and/or exert forces of different amounts on the rolling stock. According to a further embodiment, at least one processing unit following the roll stand can be a horizontal roll stand.

According to another embodiment, a controlling and/or regulating device for setting a state of a rolling stock with a machine-readable program code, may contain controlling commands and/or regulating commands that cause the controlling and/or regulating device to perform the method as described above.

According to yet another embodiment, a machine-readable program code for a controlling and/or regulating device for setting a state of a rolling stock, which code may contain controlling commands and/or regulating commands that cause the controlling and/or regulating device to perform the method as described above.

According to yet another embodiment, a data carrier with a machine-readable program code as described above may be stored on it.

BRIEF DESCRIPTION OF THE DRAWINGS

Further advantages of the invention emerge from the following exemplary embodiments, which are explained in more detail on the basis of the schematically represented drawings, in which.

DETAILED DESCRIPTION

Figure 1:
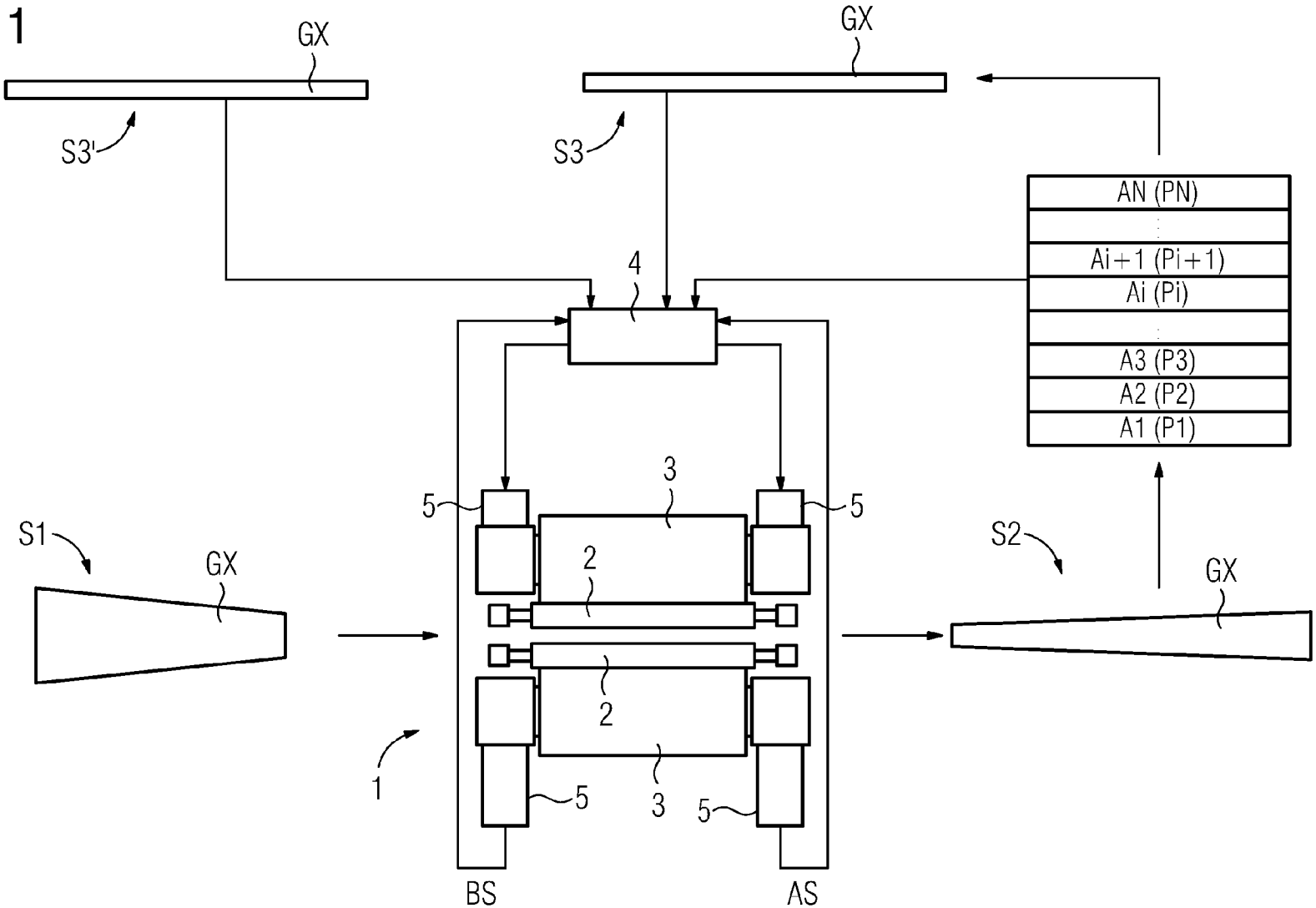
FIG. 1 shows a representation of an overview of the method according to various embodiments.

According to an embodiment, in the case of a method of the generic type it can be determined whether the at least one processing unit should be fed a rolling stock of an intermediate state that requires a thickness taper and/or camber other than zero in order to achieve a predetermined final state and, dependent thereon, controlling and/or regulating the roll stand and/or the processing means to set the respectively required intermediate state.

The final state can be predetermined, i.e. can be set. For example, the final state may be distinguished by the fact that, in the final state, a desired final thickness is achieved and the rolling stock has substantially no taper and no camber. Depending on which processing unit follows the roll stand, for example a furnace, a rolling train, a cooling unit or a cooling section or a unit for descaling, the intermediate state may be set in such a way that a predetermined final state of the rolling stock is set after the rolling stock has been processed by the corresponding processing units.

This may have the effect that, if no deviations from the desired final state are imposed on the rolling stock by the subsequent processing units, the intermediate state of the rolling stock may already have no thickness taper and/or camber. However, the other extreme case is also conceivable, the case where, depending on the subsequent processing units, from an initial state with thickness taper, an intermediate state with possibly even greater thickness taper—in comparison with the initial state—is produced, because in fact only this intermediate state with even greater thickness taper, together with the subsequent processing units, leads to a desired final state of the rolling stock, generally with no thickness taper and no camber. The thickness taper of the rolling stock may even be overcompensated, i.e. the thickness taper of the roll stand on the outlet side has an opposite algebraic sign in comparison with the thickness taper of the roll stand on the inlet side. To put it more simply, the thicker side of the strip on the inlet side becomes the thinner side of the strip on the outlet side, in comparison with the respectively opposite side of the strip on the inlet and outlet sides. A desired final state may even also possibly be defined by a certain residual thickness taper and/or camber of the rolling stock remaining, since this is required for a later application of the rolling stock in a product. This may be regarded as somewhat analogous to stepped plates.

The method according to various embodiments also allows a flexible response to any changes that occur to the processing units, such as for instance surface wear of the roll, different thermal expansions during operation of the rolls assigned to the processing unit, etc.

In principle, the thickness taper and/or camber of a rolling stock can be set as desired by pivoting the working rolls in a roll stand. Without the assistance of processing means, a change in the thickness taper of a rolling stock in a roll stand leads to a change in the camber of the rolling stock. The prior art cited at the beginning shows how a near-net strip with no thickness taper and no camber is produced by means of such processing means. And yet it is only by the present various embodiments that the intermediate state, which may, for example, comprise the thickness of the rolling stock, width of the rolling stock, thickness taper of the rolling stock, camber of the rolling stock, etc., is set in such a way that a desired final state is only obtained by the subsequent processing units. For example, in this way it is possible to make allowance for residual stresses in the rolling stock not causing curvatures directly during the rolling in the roll stand, defects in the contour of the rolls in a finishing train known as thermal crown, wear in a finishing train, etc. On account of these influences, enumerated by way of example, an intermediate state, prepared by means of the processing means and the roll stand, is set in such a way that, for example, a strip of the desired final thickness with no thickness taper and no camber is produced.

The stress which is impressed onto the rolling stock by means of processing means may be impressed mechanically, thermally or by means of electromagnetic fields. The processing means then set a desired stress or stress distribution at a specific location in the rolling stock, generally in the roll nip. An edger and/or a strong lateral guide are suitable particularly advantageously as mechanical processing means for impressing a stress onto the rolling stock.

Impressing the stress onto the rolling stock particularly allows a symmetrical or asymmetrical tensile/compressive stress distribution or transverse stress distribution to be set at the roll nip, influencing the material flow, i.e. the longitudinal flow of the material and the transverse flow of the material. This allows the thickness taper and/or camber, possibly also the thickness of the rolling stock, to be set. The impressing of the stress by means of the processing means is controlled and/or regulated in such a way that a desired stress distribution over the width of the rolling stock is set—in the rolling stock, at the roll nip.

Allowance should generally be made for the initial state of the rolling stock, from which the rolling stock is transformed into the intermediate state, since different initial states can lead to different intermediate states of the rolling stock for the same settings of the manipulated variables of the roll stand and of the processing means. These differences in the intermediate states are, however, possibly undesired. In this respect, the important parameters characterizing the initial state of the rolling stock, such as for instance thickness taper, camber, thickness, etc., may be recorded by means of corresponding recording devices. This allows the rolling stock to be transformed in a suitable way from the initial state into the intermediate state with allowance for the final state of the rolling stock and the properties of the subsequent units.

Starting from the at least one roll stand and the additional processing means that provide the intermediate state, the intermediate state may have, for example, in comparison with the initial state an increased taper, a reduced taper, a reversed taper or no taper. This applies analogously to the camber.

The controlling and/or regulating takes place on the basis of a controlling and/or regulating model. The parameters influencing processing of the rolling stock are entered in this model. They are made up of parameters characterizing the rolling stock as well as parameters characterizing the interaction of the roll stand, the processing means and the at least one subsequent processing unit or number of subsequent processing units with the rolling stock. Models that can be used by a person skilled in the art to implement the various embodiments are, for example, disclosed in DE 101 18 748 A1: "Method and device for the process-controlled modeling of an industrial installation" and, for instance, the textbook Chritianini, Shawe-Taylor: "An introduction to support vector machines and other kernel-based learning methods", Cambridge UP, 2000 which are both hereby incorporated by reference. This only represents a short extract of possibilities on which a person skilled in the art can rely.

Physical, empirical or (self-)learning models, for instance neural networks, may be used, for example, for controlling and/or regulating the roll stand and the processing means. A person skilled in the art is quite familiar with the use of such models. In the case of empirical models, reliance is placed on knowledge based on the operation or test operation of the respective installation. In particular, a model is preferably designed in such a way that it has online capability, i.e. adapts the regulating and/or controlling of the roll stand and the processing means during the operation of the steelworks in such a way that the intermediate state is set in real time, dependent on the final state and the parameters of interaction of the processing units subsequently processing the rolling stock, in such a way that a predetermined final state of the rolling stock is achieved by the processing with the subsequent units.

According to a further embodiment, allowance is made in the determination for an internal material stressing with an effect at least on the thickness taper and/or camber of the rolling stock during the further processing of the rolling stock. This ensures that material stresses that are present in the rolling stock do not lead to a significant deviation from the desired final state of the rolling stock even though allowance has been made in the regulating and/or controlling of the roll stand and the processing means for the initial state, final state and the parameters of interaction of the processing units with the rolling stock. Consequently, a relaxation of the material stressing with an effect at least on the thickness taper and/or camber of the rolling stock in one or more subsequent processing units, such as for instance a furnace or cooling section or finishing train, is also included in the setting of the intermediate state of the rolling stock. This allows a further improvement in the setting of the intermediate state to be achieved.

To make allowance for the material stressing, the material stressing in the rolling stock may be measured. Generally, however, the material stressing will be modeled by suitable models. To optimize the process control, a coupling of the measurement and calculation of the material stressing in the rolling stock may also be provided.

According to a further embodiment, the stress impressed on the rolling stock is regulated and/or controlled. The processing means are generally regulated and/or controlled in such a way that they set a desired stress, particularly stress distribution, over the width of the rolling stock. Specific regulating and/or controlling of the stress together with the, possibly dependent thereon, regulating and/or controlling of the manipulated variables of the control elements of the roll stand have the effect that the rolling stock is transformed into an intermediate state which leads to the desired final state during processing with at least one subsequent unit.

According to a further embodiment, a force exerted on the rolling stock is used for impressing the stress onto the rolling stock. The force is exerted on the rolling stock by means of a mechanical device, in order to specifically influence the stress ratios of the rolling stock located portion by portion in the roll nip. The stress in the rolling stock during the rolling can be set in the roll nip by the point of application of the force and the amount of the force in such a way that the intermediate state required to produce the final state by defined subsequent processing units is set. The force may be exerted on the rolling stock by means of a punctiform, linear or areal application region on the rolling stock.

In a further advantageous refinement, the rolling stock has a front side that is generally aligned transversely in relation to an intended transporting direction and is known as the head of the rolling stock, a position of the head of the rolling stock being recorded and the force exerted on the rolling stock being regulated and/or controlled on the basis of the recorded position of the head of the rolling stock. The recording of the head of the rolling stock is advantageous to this extent, since it is detected whether a force can be exerted on the rolling stock at all and a force of what level should be impressed onto the rolling stock at a specific position of the rolling stock in order to set a specific stress, in particular stress distribution, in the roll nip. This is of great importance particularly during the initial pass of a rolling stock in the at least one roll stand.

According to a further embodiment, a lateral guide is used as the processing means. The use of a lateral guide, particularly a strong lateral guide, gives the lateral guidance a combinational effect in the transformation of the rolling stock from its initial state into its final state, since not only does the lateral guide in this context guide the rolling stock but it is also used as a means for impressing a stress. This is particularly effective in the roll nip and, as a result, influences the intermediate state that is produced from the initial state by means of the at least one roll stand. Consequently, no additional structural measures have to be provided to perform the method according to various embodiments using a lateral guide for impressing stress onto the rolling stock.

According to a further embodiment, an edger is used as the processing means. The edger may be used as an alternative to the lateral guide for impressing stress onto the rolling stock, but also in combination with a lateral guide. The use of an edger has the advantage that the two substantially vertical working rolls of the edger can act on the rolling stock independently of one another. In particular, the rolls of the edger may be arranged in relation to one another in such a way that they are not arranged axially symmetrically in relation to a center longitudinal axis of the rolling stock and/or exert forces of different amounts on the rolling stock. The center longitudinal axis of the rolling stock is that longitudinal axis of the rolling stock that runs through the middle of the strip on the outlet side of the rolling stock in the longitudinal direction of the rolling stock. In an advantageous special case, the force of one working roll of the edger on the rolling stock is zero, i.e. this working roller is not in contact with the rolling stock. The other working roller exerts a force on the rolling stock, in order to set a stress distribution in the rolling stock over the width of the rolling stock, at the roll nip. Asymmetric stresses can be impressed on the rolling stock by the working rolls of the edger acting on the rolling stock independently of one another. This consequently also allows a more flexible setting of intermediate states. A greater range of "defects" of the subsequent processing units can be covered in this way. Consequently, by means of an edger, it can be ensured particularly advantageously that the desired final state of the rolling stock is set.

The method according to various embodiments can be used particularly advantageously if at least one processing unit following the roll stand is a horizontal roll stand. This advantage is retained in particular whenever a plurality of horizontal roll stands operating as a finishing train are arranged after the at least one roll stand. In the finishing train, the rolling stock is transformed from its intermediate state into a desired final state. This final state is generally only the desired final state if allowance for the deviations impressed onto the rolling stock by the plurality of roll stands has already been made for the intermediate state by the method according to various embodiments. Therefore, the quality of the rolling stock transformed into the final state can be further improved with regard to thickness taper and/or camber by the method according to various embodiments when used for a finishing train.

The part of the object that relates to the device is achieved by a controlling and/or regulating device according to claim 11. Such a controlling and/or regulating device for setting a state of a rolling stock can be easily retrofitted for existing installations. This allows the quality to be increased when setting a final state of a rolling stock.

Furthermore, the invention also extends to a machine-readable program code for a controlling and/or regulating device for setting a state of a rolling stock. Consequently, the machine-readable program code can also be used in already existing controlling and/or regulating devices.

This can be ensured in particular by the program code being stored on a data carrier, to which the present invention likewise extends.

FIG. 1 shows an overview of the setting of a state of a rolling stock. Starting from an initial state S1 with the rolling stock cross section GX, the rolling stock is fed to a roughing stand 1. The roughing stand 1 has a set of working rolls 2 and a set of backing rolls 3. There is also a device for adjusting the rolls in the form of a hydraulic adjustment 5. The rolling force on the operator side and on the drive side can be set by means of the hydraulic adjustment 5. Also provided are measuring devices, which measure the rolling force on the operator side and the rolling force on the drive side and feed it to a regulating device, which also regulates the hydraulic adjustment 5. A desired final state S3' of the rolling stock is also fed to the regulating device 4. The desired final state S3' is generally the state that is intended for the finished-rolled strip. The desired final state generally comprises a certain target thickness, a certain phase mixture, and the property of the rolling stock that it has no thickness taper and no camber.

The regulating device 4 is also fed information concerning which processing units the rolling stock passes through after leaving the roughing stand 1. In particular, the regulating device is fed the extent to which the respective processing units have an influence on the geometry of the rolling stock. The geometry of the rolling stock may be influenced by thermal processes, for example heating processes or cooling processes, since internal stresses in the rolling stock are changed in this way, or else by direct mechanical action on the rolling stock, for example by rolling of the rolling stock. The changing of the geometry of the rolling stock by thermal and/or mechanical processes is also dependent, inter alia, on the extent to which internal stresses are already present in the rolling stock prior to this respective unit. To this extent, allowance should already be made for the initial state S1 of the rolling stock, possibly for the processing of the rolling stock by means of a processing unit.

By means of the information with respect to the processing units following the roughing stand and the desired final state, the rolling stock is transformed into an intermediate state S2 by means of regulating the rolling operation in the roughing stand 1, for example proceeding in some other way, as known from the laid-open patent application WO 2006/119984 A1. The intermediate state S2 is distinguished by the fact that it is dependent on the processing steps then provided for the rolling stock. This intermediate state S2 will generally have a thickness taper and/or a camber. The rolling stock with the intermediate state S2 subsequently passes, for example, through a plurality of processing units, for instance A1, A2, A3 to AN. After passing through the last processing unit AN, the final state S3 of the rolling stock is set. This state is fed to the regulating device 4 of the roughing stand. Among the operations that take place there is a comparison between the desired final state S3' and the actual final state S3. Unless device-related measures are taken to prevent them, two limiting cases are decisive in the processing of rolling stock with a thickness taper into metal strip:

1. The roll nip is set such that the relative decrease in thickness is equal at every point along the roll nip. As a result, the lengthening of the material is equal at all points along the widthwise direction and there is no camber-like distortion of the strip, but the thickness taper is retained through to the finished strip. Since a final state with thickness taper is generally undesired, this does not represent a solution to the problem.
2. The roll nip may be set symmetrically, i.e. the rolls are parallel to one another apart from bending effects. However, because of the thickness taper that is present in the rolling stock, there is an uneven deformation over the width of the rolling stock. On account of the differing thickness of the rolling stock on the operator side and on the drive side, this leads to a differing lengthening of the material over the width of the rolling stock. This causes the formation of a camber. The presence of a camber exceeding certain limiting dimensions leads to difficulties in the further processing of the rolling stock.

In order to produce a rolling stock that has substantially no thickness taper and no camber, it is first required to record a camber or taper of the rolling stock when it occurs. There are various possibilities in this respect. According to the prior art, for example, when a centered rolling stock with thickness taper, for instance a slab, is concerned, a differential rolling force between the operator side and the drive side of the roughing stand 1 can be established. However, this difference in rolling force is not definitively attributable to the formation of a camber. The cause of the difference in rolling force between the operator side and the drive side may also be due to the strip being skewed during rolling, i.e. running off-center, or having an inhomogeneous temperature over the width. The latter results in a deforming resistance that changes over the width, and consequently in a deforming force for producing a defined rolling stock state that varies over the width.

In order to reliably detect a camber, it is therefore also necessary to use, for example, a lateral guide that is subjected to a distinct increase in force by the curved rolling stock during the formation of a camber, since the camber presses on the lateral guide. However, if it is formed as a strong lateral guide, it can prevent or suppress the formation of the camber.

To determine the original thickness taper on the basis of which the camber occurs, and the degree of camber, it is also necessary to carry out a recording of the strip edge, for example by means of a strip measuring device, and to use the detection of the strip edge for camber diagnosis. Cameras or laser-based measuring systems may be used, for example, as measuring systems.

Only when these three indicators are present is it possible to ascertain a thickness profile and a camber of the rolling stock, as well as the dimensions thereof. Alternatively, reliable measuring of the rolling stock with regard to thickness camber may take place particularly advantageously at the feed to the furnace.

It is known from the prior art cited at the beginning to avoid such thickness taper and/or camber for a rolling stock directly after the roughing stand, i.e. to bring about the production of a rolling stock that has substantially no camber and no taper by processing the rolling stock with the roughing stand.

It is also possible for the case to occur where the thickness taper of the rolling stock running into the rolling stand is too great, i.e. the force on the lateral guide that is produced by the forming of the camber cannot be absorbed by it or leads to it being destroyed. If this case occurs, it is necessary to dispense with the complete roll alignment control and pivot the rolls in accordance with the taper. A reduction of the taper of the running-in rolling stock to the extent that the force acting on the lateral guide does not destroy it may possibly also take place by means of the roll stand. The remaining taper is then progressively eliminated by subsequent passes.

However, it is problematic here that the thickness taper and/or camber that are set substantially to zero may be transformed back into a thickness taper and/or camber by subsequent processing units. Such changing of the rolling stock geometry may be caused, for example, by the rolling stock itself, for instance by internal stresses, or else by external influences on the rolling stock, for instance worn rolls, thermal crown, roll offset, roll bending, temperature changes, introduction of substances, for instance water, to the rolling stock, etc. . . .

This has the consequence that the rolling stock may once again have a thickness taper and/or camber in the final state. However, this can be avoided by the parameters that influence the geometry of the rolling stock of the processing units A1, A2, A3, . . . , AN arranged after the roughing stand 1 being included in the regulating of the roughing stand 1. By means of the sets of parameters P1, P2, P3, . . . , PN that influence the geometry of the rolling stock of the subsequent processing units A1, A2, A3, . . . , AN, an intermediate state of the rolling stock that the rolling stock must have in order to achieve a desired final state S3', or in the case of a specific final thickness to have no taper and no camber, after passing through the desired processing units is determined by means of a model with the inclusion of the initial state S1 and preceding process steps.

On the basis of the intermediate state determined, the roughing stand 1 is then regulated from the initial state S1 in such a way that the determined intermediate state coincides with the set intermediate state S2 of the rolling stock. The intermediate step S2 that is set by the roughing stand 1 is preferably compared with the determined intermediate state and the regulating is changed in such a way that the set intermediate state S2 of the rolling stock and the determined intermediate state for the rolling stock coincide with the best possible match.

The intermediate state S2 of the rolling stock that is set after passing through the roughing stand 1 is consequently dependent on the process influences of the subsequent processing units A1, A2, A3 . . . , AN on the rolling stock, which can be reproduced by sets of parameters P1, P2, P3, . . . , PN, on the initial state S1 and possibly on process parameters of preceding processes that have, for instance, influenced the state of internal stress of the rolling stock.

For example, by means of a width measuring device and a profile measuring device after a finishing train which the rolling stock has passed through, an intermediate state that leads to a desired final state—i.e. in this case after the finishing train—can be determined. For this purpose, the thickness taper and camber are measured by means of the aforementioned devices and fed to the regulating device 4. In conjunction with the differential rolling force known from the prior art, the determined intermediate state for the rolling stock is set from the initial state S1. It is generally advantageous if the initial state S1 of the rolling stock is known, and this is fed to the regulating device 4, so that the latter can control and/or regulate the roughing stand 1 correspondingly.

The profile measurement of the rolling stock and the width measurement of the rolling stock may be recorded at a wide variety of locations within the rolling process. Possibly, therefore, the influence of each processing unit A1, A2, A3, . . . , AN on the geometry of the rolling stock may be determined individually for a given intermediate state or given initial state. The measured values recorded are preferably filtered in a measured-value processing operation and assigned to the individual portions of strip with the assistance of the strip tracking. The measured values are then available for the automation of the process, in particular for the regulating of the roughing stand 1.

The thickness taper and/or camber of the final state S3 of the rolling stock, for example after passing through the finishing train, depends on the thickness taper and/or camber after the roughing train or after the roughing stand 1 and further process parameters, in particular on the process parameters P1, P2, P3, . . . PN of the subsequent processing units A1, A2, A3, . . . , AN. In order to implement them in the model for regulating the roughing stand 1, a set of selected process parameters P1, P2, P3, . . . , PN is fed, for example, to an empirical model, for instance an inheritance buffer or neural network. Dependent on a sufficient amount of data, the model is capable of predicting the thickness taper and/or camber of the finished strip as a function of the thickness camber of the near-net strip. Alternatively, physical models, for instance models based on finite elements, or other suitable models may be used. A person skilled in the art is quite familiar with such models.

On the basis of this information, the rolling stock can be transformed from the initial state S1 into an intermediate state S2 which, after passing through the processing steps that are further provided for the rolling stock, leads to a desired final state S3 which substantially coincides with the desired final state S3'.

To calculate the required thickness taper and/or camber of the near-net strip, a further model may be used for the downstream processing units A1, A2, A3, . . . , AN of the rolling strip, in order to optimize further the thickness taper and the camber of the finished strip.

Figure 2:
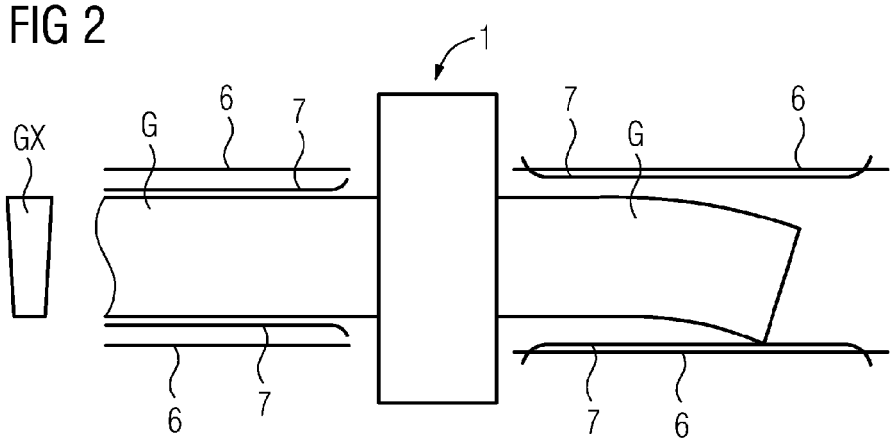
FIG. 2 shows the formation of a camber during a rolling operation in a roughing stand.

FIG. 2 shows the formation of a camber for a rolling stock G with a thickness taper in a roughing stand 1. In FIG. 2, a cross-sectional representation GX of a rolling stock G with a thickness taper on the inlet side is shown. The rolling stock G is transported to a roughing stand 1 on a roller conveyor 6. In order that it runs into the roughing stand 1 in a desired way, lateral guides 7 are provided. Once thickness reduction has been performed by the roughing stand 1, the rolling strip G has a camber caused by the thickness taper. The lateral guide 7 on the outlet side that is shown in FIG. 2 has an opened position here. This prevents the rolling strip G with camber from catching on the lateral guide 7 on the outlet side and the rolling operation having to be aborted completely.

Since the rolls in the roughing stand 1 are kept substantially parallel by the roll alignment control, the thickness taper of the rolling stock causes the formation of a camber. The thicker side of the taper has a higher material flow in the longitudinal direction than the thinner side of the taper, resulting in a curvature of the rolling stock in the transporting plane of the rolling stock G. Such a strip can only be further processed with very great difficulty in subsequent processes.

Figure 3:
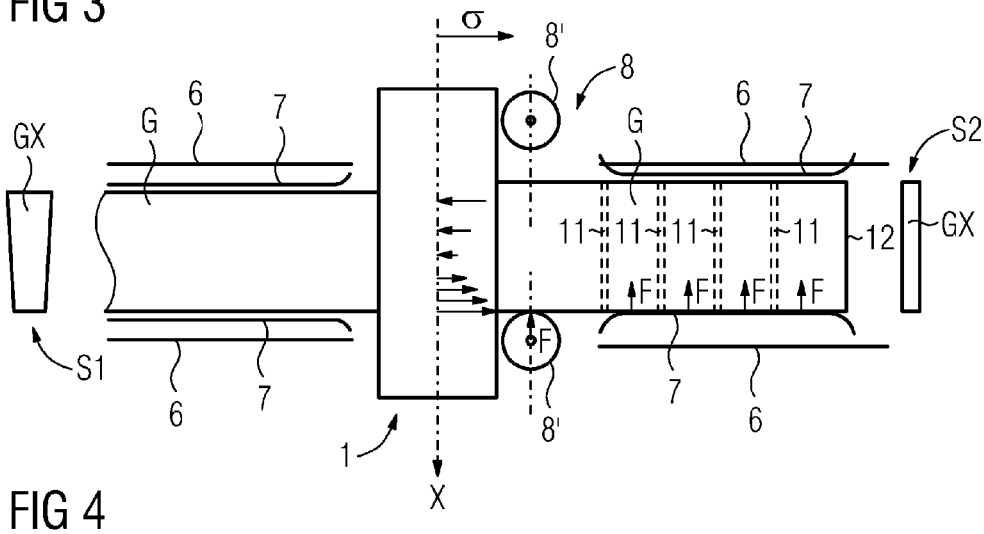
FIG. 3 shows the application of a method according to various embodiments to the setting of a defined intermediate state of the rolling stock.

FIG. 3 likewise shows a cross section of a rolling stock with thickness taper that runs into a roughing stand 1. This rolling stock is also transported to the roughing stand by means of a roller conveyor 6 and a lateral guide 7. An edger 8 with two vertical working rolls 8' and a strong lateral guide 7 is arranged on the outlet side. A force is impressed onto the rolling stock G on the outlet side by the edger 8 and by the strong lateral guide 7.

In particular, it is advantageous if the lateral guide 7 on the left and the lateral guide on the right—as viewed in the transporting direction of the strip—can be moved independently of one another. This is generally not the case, since the lateral guides 7 are only adjustable symmetrically to one another in relation to the middle of the strip. This is ensured by a synchronization shaft of the lateral guides 7. More advantageously, for the setting of the intermediate state of the rolling stock or the defined stress distribution in the roll nip, this synchronization shaft and any other mechanical coupling of the lateral guides is/are omitted, so that the lateral guide on the left and the lateral guide on the right are movable independently of one another—at least on the outlet side. In particular, it is advantageous to set the then independently movable lateral guides in such a way that the end of the lateral guide facing toward the roughing stand is further away from the middle of the strip than the end of the lateral guide 7 facing away from the roughing stand. That is to say that the lateral guide 7 is adjustable in a funnel-shaped manner. This allows the introduction of force to the rolling stock G to be additionally controlled and/or regulated.

Furthermore, a device 11 for recording the position of the head of the strip 12 is provided. The time-dependent recording of the position of the head of the strip 12 makes it easier to control the lateral guide 7 and the edger 8. The use of the edger 8 and of the lateral guide 7, the level of the force and the force distribution along the strip are controlled in such a way as to set at the roll nip a stress distribution $\sigma$, which allows the required intermediate state of the rolling stock G to be set in such a way that the desired final state is achieved by the subsequent processing units.

Figure 4:
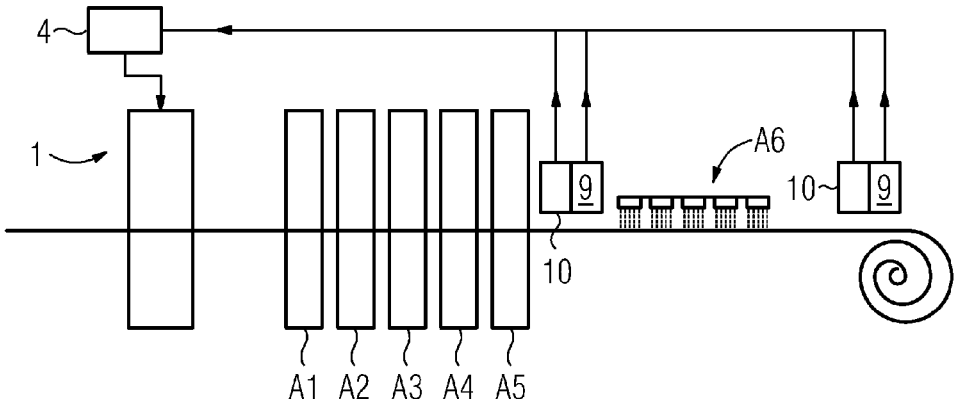
FIG. 4 shows a roughing stand and a finishing train arranged after the roughing stand.

FIG. 4 shows a roughing stand 1 with a finishing train following the roughing stand and comprising the five roll stands A1, A2, A3, A4 and A5, a strip-width measuring device 10, arranged after the rolling train, and a profile measuring device 9. Arranged in turn after the latter is a cooling section A6, after which there is likewise a width measuring device 10 and a profile measuring device 9. Subsequently, the strip is coiled up on a coiler. The strip-width measuring device 10 and the profile measuring device 9 respectively measure the camber and thickness taper of a strip after A5 and A6, respectively. The thickness tapers and/or cambers determined by means of the width measuring devices 10 and the profile measuring devices 9 are fed to a controlling and/or regulating device 4, which incorporates the values in the model for determining the intermediate state. Starting from the determined intermediate state, the roughing stand is controlled and regulated in such a way that the rolling stock is transformed from its initial state with thickness taper or no taper into an intermediate state which in turn is transformed into a desired final state by processing of the rolling stock by the subsequent processing units A1 to A6. The final state of the strip is determined in FIG. 4 by the width measuring device or profile measuring device mounted after the cooling device A6. Such a procedure allows the fluctuation of the final state to be further reduced in comparison with the prior art, and consequently the quality of the finished-rolled metal strip to be further increased.

What is claimed is:

1. A method for processing a rolling stock by a rolling stand and at least one subsequent processing unit, the method comprising the steps of:

determining by a regulating device a non-zero influence on a geometry of the rolling stock that is associated with the at least one subsequent processing unit, the influence on the geometry including at least one of a influence on a thickness taper and a camber of the rolling stock, determining by the regulating device an intermediate geometry of the rolling stock to be output by the rolling stand such that the determined influence on the geometry associated with the at least one subsequent processing unit will provide a desired final geometry of the rolling stock after processing by the at least one subsequent processing unit, the intermediate geometry having at least one of a non-zero thickness taper and a non-zero camber, controlling the roll stand to transform the rolling stock from an initial state having an initial geometry into an intermediate state having the determined intermediate geometry, and using the at least one subsequent processing unit to transform the rolling stock from the intermediate state having the intermediate geometry to a final state having the desired final geometry.

2. The method according to claim 1, further comprising the regulating device determining an influence on an internal material stressing of the rolling stock that is associated with the at least one subsequent processing unit.

3. The method according to claim 1, wherein the rolling stock has a head that is generally aligned transversely with an intended transporting direction , wherein a position of the head of the rolling stock is recorded, and wherein a force exerted on the rolling stock is controlled based on the recorded position of the head of the rolling stock.

4. The method according to claim 1, wherein the rolling stand comprises a lateral guide.

5. The method according to claim 1, wherein the rolling stand comprises an edger.

6. The method according to claim 5, wherein the edger comprises working rolls that are not arranged axially symmetrically in relation to a center longitudinal axis of the rolling stock.

7. The method according to claim 1, wherein the at least one processing unit following the roll stand comprises a horizontal roll stand.

8. The method according to claim 1, wherein the rolling stock is a near-net strip.

9. The method according to claim 1, wherein the roll stand is a roughing stand.

10. A controlling or regulating device for processing of a rolling stock by a rolling stand and at least one subsequent processing unit, comprising:

non-transitory storage means storing a machine-readable program code, which contains instructions executable by a processor to:

determine a non-zero influence on the geometry of the rolling stock that is associated with the at least one subsequent processing unit, the influence on the geometry including at least one of a influence on a thickness taper and a camber of the rolling stock, determine an intermediate geometry of the rolling stock to be output by the rolling stand such that the determined influence on the geometry associated with the at least one subsequent processing unit will provide a desired final geometry of the rolling stock after processing by the at least one subsequent processing unit, the intermediate geometry having at least one of a non-zero thickness taper and a non-zero camber, control the roll stand to transform the rolling stock from an initial state having an initial geometry into an intermediate state having the determined intermediate geometry, and control the at least one subsequent processing unit to transform the rolling stock from the intermediate state having the intermediate geometry to a final state having the desired final geometry.

11. The controlling or regulating device according to claim 10, wherein the device is further operable to determine an influence on an internal material stressing of the rolling stock that is associated with the at least one subsequent processing unit.

12. The controlling or regulating device according to claim 10, wherein the rolling stock has a head that is generally aligned transversely with an intended transporting direction, wherein a position of the head of the rolling stock is recorded, and wherein a force exerted on the rolling stock is controlled based on the recorded position of the head of the rolling stock.

13. The controlling or regulating device according to claim 10, wherein the rolling stand comprises a lateral guide.

* * * * *